US006352363B1

(12) United States Patent
Munger et al.

(10) Patent No.: US 6,352,363 B1
(45) Date of Patent: Mar. 5, 2002

(54) SHIELDED X-RAY SOURCE, METHOD OF SHIELDING AN X-RAY SOURCE, AND MAGNETIC SURGICAL SYSTEM WITH SHIELDED X-RAY SOURCE

(75) Inventors: Torrey Munger; Peter Werp, both of St. Louis, MO (US)

(73) Assignee: Stereotaxis, Inc., St. Louis, MO (US)

( * ) Notice: Subject to any disclaimer, the term of this patent is extended or adjusted under 35 U.S.C. 154(b) by 0 days.

(21) Appl. No.: 09/761,104

(22) Filed: Jan. 16, 2001

(51) Int. Cl.[7] ..... H01J 35/16
(52) U.S. Cl. ..... 378/203
(58) Field of Search ..... 378/203

(56) References Cited

U.S. PATENT DOCUMENTS 4,352,021 A * 9/1982 Boyd et al. ..... 378/12

* cited by examiner

*Primary Examiner*—Craig E. Church
(74) *Attorney, Agent, or Firm*—Harness, Dickey & Pierce, PLC

(57) ABSTRACT

Generally, the shielded x-ray source of the present invention has a cast shield of an iron based material substantially enclosing and closely conforming to the x-ray tube to shield the x-ray tube imaging beam from interference from magnetic fields. The method of the present invention includes providing a shield cast from an iron-based material in a shape having a cavity to receive and closely conform to the x-ray tube, and installing the cast shield around the x-ray tube. The magnetic surgical system comprising at least one magnetic for magnetically navigating a medical device in an operating region in a patient's body, and an imaging apparatus including at least one x-ray tube for imaging the operating region. A cast shield of an iron-based material substantially enclosing and closely conforming to the at least one x-ray tube.

23 Claims, 4 Drawing Sheets

SHIELDED X-RAY SOURCE, METHOD OF SHIELDING AN X-RAY SOURCE, AND MAGNETIC SURGICAL SYSTEM WITH SHIELDED X-RAY SOURCE

BACKGROUND OF THE INVENTION

This invention relates to magnetically shielding x-ray sources, and in particular to magnetically shielded x-ray sources, methods of magnetically shielding x-ray sources, and to a magnetic surgical system with a magnetically shielding x-ray source.

Recently magnetic surgery techniques have been developed in which one or more permanent magnets or electromagnets is used to magnetically navigate medical devices and substances in an operating region inside the patient's body. To monitor the procedure it is desirable to at least periodically if not continuously image the operating region. A widely used method of imaging is x-ray fluoroscopy, however the strong magnetic fields generated by the magnets can interfere with the operation of the x-ray sources. The increasing use of fluoroscopic imaging in the vicinity of significant magnetic fields such as generated by magnetic resonance imaging (MRI) devices and magnetic surgery systems (MSS) has resulted in a need for the protection of the tubes which provide the x-ray beam as well as the image intensifiers on the screens which receive the imaged beam. Conventional shielding in medical situations most often uses mu-metal or a combination of mu-metal and low-carbon steel formed sheets. These are not very useful in shielding of larger magnetic fields in congested regions near x-ray or fluoroscopic equipment.

Two elements in the typical x-ray generating tube are vulnerable to magnetic fields significantly stronger than the Earth's field. The electron beam which impacts on the anode to create the x-rays is, near its origin, of very low energy, and therefore soft to bending by a magnetic field. Such bending can shift an image, twist the image, or change its contrast and brightness. The beam can also be defocused and cause a completely washed out image. Experience shows that commonly designed x-ray tubes show effects of magnetic fields in the region of 50 Gauss, or so, depending on direction of the field.

A second element of magnetic vulnerability occurs in tubes with rotating metal anodes. These anodes can have eddy currents which cause a drag that slows the anode rotation. The magnetic field levels at which this effect is significant are more variable, depending on field direction and variation in time. Experience has shown that slowly varying fields of 50 Gauss or so do not result in significant effect on the anode rotation.

Prior attempts to shield the x-rays using housing formed from sheet metal have generally been unsatisfactory because of the difficulty and expense of fabricating a shield that closely conforms to the x-ray tube yet does not interfere with the operation of the x-ray tube. A powerful x-ray generating tube has several electrical leads as well as coolant tubes connected to it. The leads, and other features of the design, cause the design of a magnetic shield for the tube to be a matter totally different from the design of magnetic shields commonly in use in the past. Such common shields are used for computer monitors and for sensitive equipment.

It is known that field penetration of a shield through holes leads to "leakage" to the interior. (See Classical Electrodynamics, 2nd Ed., J. D. Jackson, Wiley and Sons, pages 201–204 and 408 to 411, the latter to be evaluated in the limit of very low frequencies). A larger aperture leads to deeper field penetration. Common magnetic shield design for monitors and delicate apparatus uses layered permeable material, sometimes containing "mu-metal" either of several grades or in conjunction with low-carbon steel. The high permeability mu-metal is vulnerable to relatively small fields, say of the order of one Gauss, because it draws so much flux into its layer that it saturates. In the protection of an x-ray generating tube, such high permeability material is not necessary, or even desirable. This is because the fields in question, even inside the shield, are at a level at which mu-metal would saturate, at least in layers of commercially feasible thickness.

Another effect is the concentration of field caused by sharp curves in a shield surface, resulting in concentration of flux causing a local high field, and/or saturation of the shield.

A lesser known effect is the geometrical effect of "flux directing" by the shape of the shield. In this effect there is a dependence on the size and distance of the source field relative to the shield. A relatively close source field can saturate the front of a shield before achieving a high field at the rear. If the same source field at the location of the center of the shield were caused by a physically large source, this front-rear discrimination would not occur. In the relatively close case, the shape of the shield can be important, and the location of holes should be at the rear (away from the source).

In the regime of shielding concerned here, layering of any permeable material is ineffective. This is because the upper boundary of field within a layer is no more than 25 Tesla due to saturation, and any feasible layer will saturate well before it can remove enough magnetic flux to prevent saturation in the next layer. For an ideal enclosed shield the net effect is that n layers of thickness t will have virtually the same interior field as a single layer of thickness n times t.

SUMMARY OF THE INVENTION

The present invention relates to a shielded x-ray source, a method of shielding an x-ray source, and a magnetic surgical system with shielded x-ray source.

Generally, the shielded x-ray source of the present invention has a cast shield of an iron based material substantially enclosing and closely conforming to the x-ray tube to shield the x-ray tube imaging beam from interference from magnetic fields. The shield is preferably made of cast iron, but could also be made of cast steel. The shield is preferably at least ¼ inch thick. Because the shield is cast, it can be inexpensively made to closely conform to the external shape of the x-ray tube. There is preferably less than ¼ inch gap between the x-ray tube and the shield, and more preferably nor more than 1/16 inch gap between the x-ray tube and the shield. The shield is preferably cast in two or more pieces, which are assembled around the x-ray tube and secured together. Such a field can be more efficient than others and therefore significantly lighter for mounted on c-arms and other apparatus.

Moreover, it will have a smaller magnetic moment and less disturbing force on it than less efficient shields.

Generally, the method of the present invention comprises providing a shield cast from an iron-based material in a shape having a cavity to receive and closely conform to the x-ray tube, and installing the cast shield around the x-ray tube. The shield is preferably cast iron, but could also be made of cast steel. The shield is preferably at least ¼ inch thick. Because the shield is cast, it can be inexpensively made to closely conform to the external shape of the x-ray tube. There is preferably less than ¼ inch gap between the x-ray tube and the shield, and more preferably nor more than 1/16 inch gap between the x-ray tube and the shield. The shield is preferably cast in two or more pieces, which are assembled around the x-ray tube and secured together.

Generally, the magnetic surgical system comprising at least one magnetic for magnetically navigating a medical device in an operating region in a patient's body, and an imaging apparatus including at least one x-ray tube for imaging the operating region, the improvement including a cast shield of an iron-based material substantially enclosing and closely conforming to the at least one x-ray tube. The shield is preferably cast iron, but could also be made of cast steel. The shield is preferably at least 1/4 inch thick. Because the shield is cast, it can be inexpensively made to closely conform to the external shape of the x-ray tube. There is preferably less than 1/4 inch gap between the x-ray tube and the shield, and more preferably nor more than 1/16 inch gap between the x-ray tube and the shield. The shield is preferably cast in two or more pieces, which are assembled around the x-ray tube and secured together.

BRIEF DESCRIPTION OF THE DRAWINGS

Corresponding reference numerals indicate corresponding parts throughout the several views of the drawings.

DETAILED DESCRIPTION OF THE INVENTION

Figure 1:
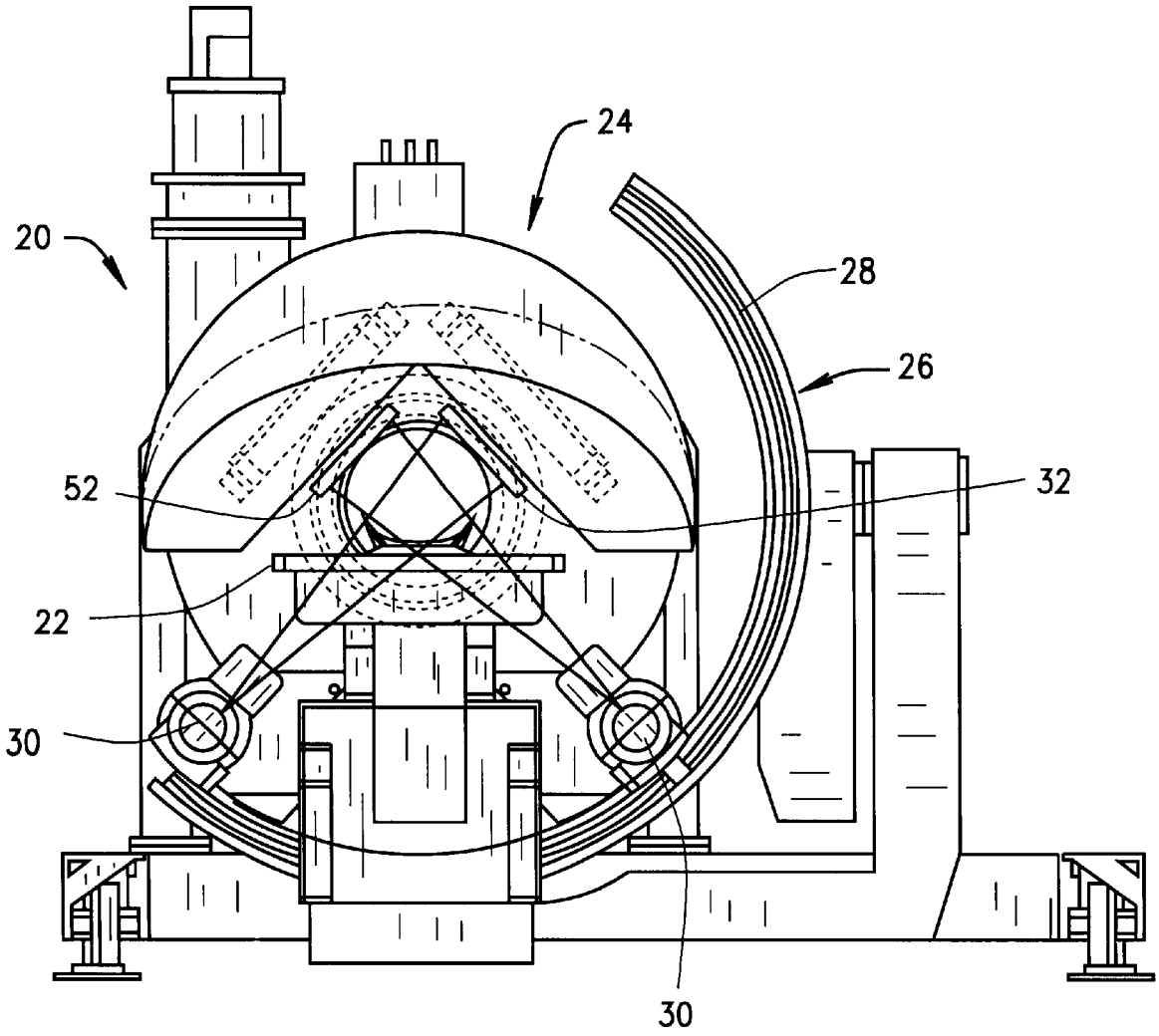
FIG. 1 is an end elevation view of a magnetic surgery system with a magnetically shielded x-ray source in accordance with the principles of this invention.
Figure 2A:
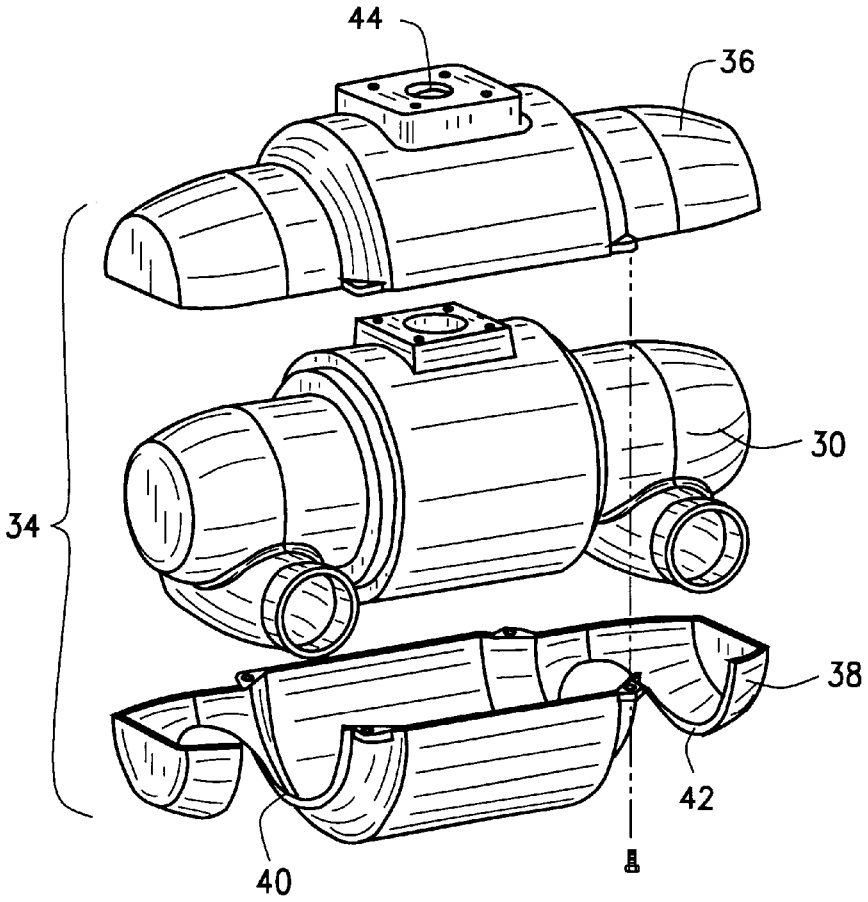
FIG. 2*a* is an exploded perspective view of the cast x-ray tube shield and x-ray tube in accordance with the principles of this invention.
Figure 2B:
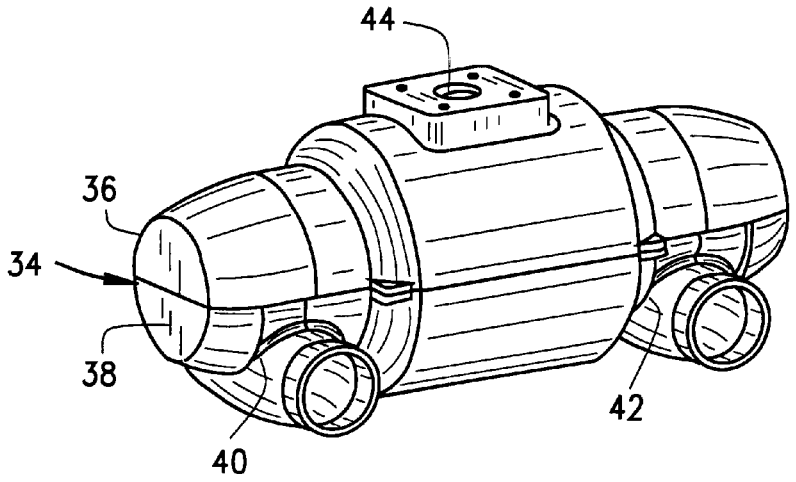
FIG. 2*b* is a perspective view of the cast x-ray tube shield installed around an x-ray tube.

A magnetic surgery system constructed according to the principles of this invention is indicated generally as 20 in FIG. 1. The magnetic surgery system 20 comprises a patient support 22, a magnet system 24 for generating magnetic fields in an operating region in a patient lying on the patient support, and an imaging system 26 for imaging the operating region in the patient. As shown in FIG. 1, the imaging system 26 comprises a C-arm 28, and two x-ray sources, such as x-ray tubes 30 and two imaging plates, such as amorphous silicon last plates 32, each aligned with one of the x-ray tubes. The imaging system is thus capable of providing bi-planar imaging of the operating region of a patient on the patient support 22. Of course the imaging system 26 could be of some other design and construction, but would still include at least one x-ray tube 30.

Figure 3A:
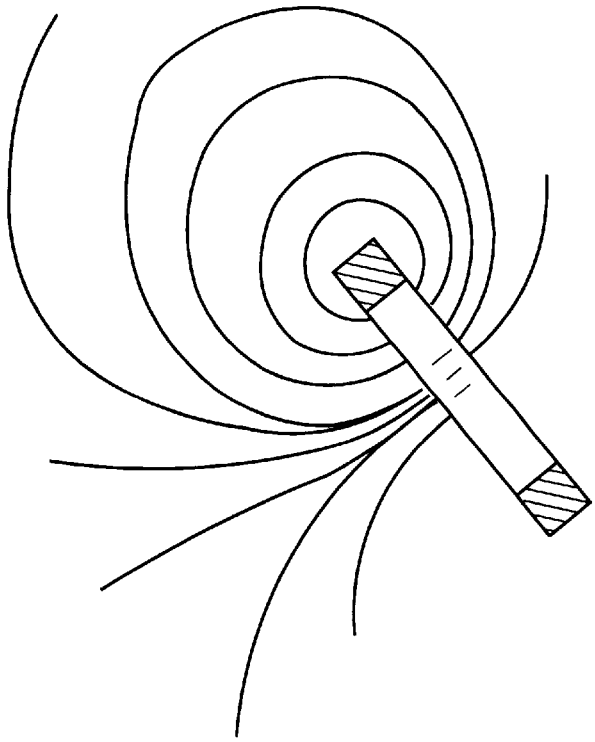
FIG. 3A is a drawing of the field lines created by a magnet from a magnetic surgery system as they would extend through an unshielded x-ray source.
Figure 3B:
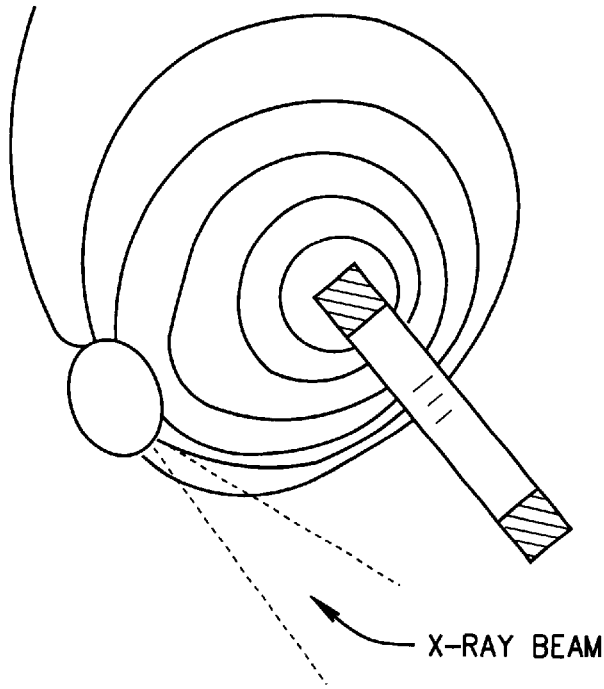
FIG. 3B is a drawing of the field lines created by a magnet from a magnetic surgery system as they would extend around an x-ray source shielded in accordance with the principles of this invention.

FIG. 3 shows a cross section of the magnetic field lines from a representative magnet without a permeable material nearby, and FIG. 3A shows in the same cross-section with a permeable shield in a typical close location to it. This illustrates how the field lines are pulled into the permeable shield material both on the outside (where it is only relevant if it leads to saturation) and on the inside, where it reduces the field seen by an x-ray tube in that region.

FIG. 3A illustrates the problem of using an unshielded x-ray tube in the presence of strong magnetic fields, such as those created in the vicinity of the permanent magnets or electromagnets of a magnetic surgery system. As shown in FIG. 3A, the field lines from a magnet in the magnetic surgery system 20 pass through the x-ray tube 30, potentially interfering with the generation of an x-ray beam.

Figure 4:
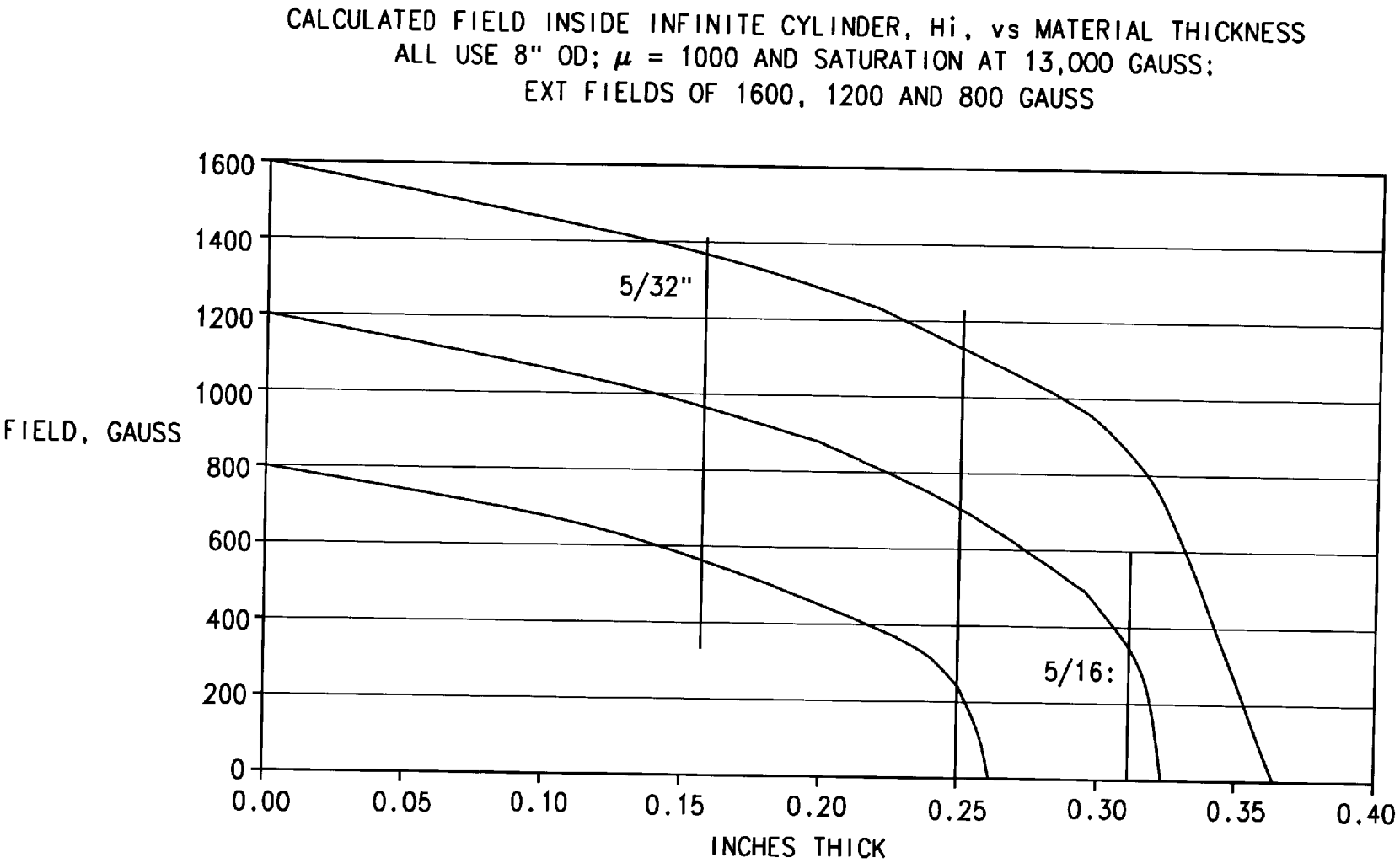
FIG. 4 is a graph showing the relationship between the thickness of the shield verses magnetic field inside the shield.

In accordance with the principles of this invention, a shield 34 is cast from a highly magnetically permeable ferrous material, such as a low carbon cast iron, or cast steel. Casting the shield 34 allows the shield to be made in a shape that closely conforms to the exterior of the x-ray tube 30. The shield 34 is preferably shaped so that the gap between the shield and the x-ray tube is not more that about 1/4 inch, more preferably not more than about 1/16 inch. The shield is preferably at least 1/4 inch thick. As shown in FIG. 4, in an applied magnetic field of 0.08 T, a thickness of 1/4 inch is sufficient to keep the magnetic field inside the shield to less than about 50 Gauss.

FIG. 4 shows the results of iterative calculations which deal with the nonlnearities of magnetization characteristics of a shielding material having characteristics common to low carbon steels or cast irons. The permeability used for these calculations is 1000 and saturation is 13,000 Gauss, which are typical numbers for cast permeable materials. The results are most sensitive to permeability, but change only marginally for variations in permeability from a few hundred to a few thousand. The figure also shows curves for three different external fields transverse to the shield surface. The surface of an infinitely long cylinder represents an effectively closed-end cylinder of ordinary length.

It is common in magnetic surgery applications for the imaging tube shield to experience fields of 800 Gauss or somewhat greater. From the figure it is apparent that for such fields no shield thinner than 1/4 inch will results in interior fields lower than the 50 Gauss determined to be safe with commonly used x-ray tubes. If fields as large as 1200 Gauss are present, a shield slightly greater than 5/16 inch thick will be needed.

Actual shields can have minor apertures in limited size with minimal effect. Also, they need to have judiciously located sharp comers in order to not have internal fields which are large near sensitive sections of the x-ray tube inside. The results of the above FIG. 4 have been shown to be representative of such actual shields, providing they are closely fitting around the entrance aperture and necessary holes for cables and cooling leads.

The shield 32 is preferably cast in at least two pieces 36 and 38. The shield 34 is installed on the x-ray tube 30 by placing the two pieces 36 and 38 around the x-ray tube and securing them. Holes for the electrical and cooling entrances 40 and 42, respectively, are at the rear of the shield 34, i.e., away from the part closest to the source field. A shield aperture 44 at the front for the x-ray beam exit is designed to have a minimum size which will pass the beam. This has been found experimentally to permit sufficiently small magnetic field penetration, in shield locations where the imaging c-arm is used.

Over all, a field less than 50 Gauss is found at the location of the initial part of the electron beam of the generating tube, when a field of 800 Gauss is present without the shield. This field is created by a coil of 530,000 ampere turns, of mean radius 8.5 inches, and located 27 inches from the front center of the shield.

What is claimed is:

1. In a magnetic surgical system comprising at least one magnetic for magnetically navigating a medical device in an operating region in a patient's body, and an imaging apparatus including at least one x-ray tube for imaging the operating region, the improvement including a cast shield of an iron-based material substantially enclosing and closely conforming to the at least one x-ray tube.

2. The magnetic surgical system according to claim 1 wherein the cast shield is made of cast iron.

3. The magnetic surgical system according to claim 1 wherein the cast shield is made of cast steel.

4. The magnetic surgical system according to claim 1 wherein the cast shield is at least about ¼ inch thick.

5. The magnetic surgical system according to claim 4 wherein the cast shield is at least about ⅝ inch thick.

6. The magnetic surgical system according to claim 1 wherein the cast shield so closely conforms to the x-ray tube that there is no more than about a ¼ inch gap between the cast shield and the x-ray tube.

7. The magnetic surgical system according to claim 6 wherein there is no more than about a 1/16 inch gap between the cast shield and the x-ray tube.

8. In combination with a x-ray tube, a cast shield of an iron based material substantially enclosing and closely conforming to the x-ray tube to shield the x-ray tube imaging beam from interference from magnetic fields up to at least about 0.08 Tesla.

9. The combination according to claim 8 wherein the cast shield is made of cast iron.

10. The combination according to claim 8 wherein the cast shield is made of cast steel.

11. The combination according to claim 8 wherein the cast shield is at least about ¼ inch thick.

12. The combination according to claim 11 wherein the cast shield is at least about ⅝ inch thick.

13. The combination according to claim 8 wherein the cast shield so closely conforms to the x-ray tube that there is no more than about a ¼ inch gap between the cast shield and the x-ray tube.

14. The combination according to claim 13 wherein there is no more than about a 1/16 inch gap between the cast shield and the x-ray tube.

15. The combination according to claim 13 wherein the shield is constructed so that in an applied field of 0.08 T, the magnetic field inside the shield is less than about 50 Gauss.

16. A method of shielding the x-ray tube from a medical imaging device from interference from magnetic fields generated in the vicinity of the x-ray tube, the method comprising: casting a shield from an iron-based material in a shape having a cavity to receive and closely conform to the x-ray tube, and installing the cast shield around the x-ray tube.

17. The method according to claim 16 wherein the iron based material is a low carbon iron.

18. The method according to claim 16 wherein the iron based material is steel.

19. The method according to claim 16 wherein the shield is cast at least ¼ inch thick.

20. The method according to claim 19 wherein the shield is cast at least ⅝ inch thick.

21. The method according to claim 16 wherein the shield is cast in a shape such that when installed on the x-ray tube there is not more than a ¼ inch gap between the x-ray tube and the shield.

22. The method according to claim 21 wherein the shield is cast in a shape such that when installed on the x-ray tube there is not more than a 1/16 inch gap between the x-ray tube and the shield.

23. The method according to claim 16 wherein the shield is formed in two parts, and wherein the step of installing the shield comprises securing the two parts together around the x-ray tube.

* * * * *